US011122881B2

(12) United States Patent
Komiyama

(10) Patent No.: US 11,122,881 B2
(45) **Date of Patent: *Sep. 21, 2021**

(54) CHEMICAL SOLUTION SUPPLY APPARATUS AND CHEMICAL SOLUTION SUPPLY IMPLEMENT

(71) Applicant: KOBAYASHI PHARMACEUTICAL CO., LTD., Osaka (JP)

(72) Inventor: Satoru Komiyama, Osaka (JP)

(73) Assignee: KOBAYASHI PHARMACEUTICAL CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/781,906

(22) PCT Filed: Dec. 9, 2016

(86) PCT No.: PCT/JP2016/086781

§ 371 (c)(1),
(2) Date: Jun. 6, 2018

(87) PCT Pub. No.: WO2017/099235

PCT Pub. Date: Jun. 15, 2017

(65) Prior Publication Data

US 2018/0332947 A1 Nov. 22, 2018

(30) Foreign Application Priority Data

Dec. 10, 2015 (JP) ..... JP2015-241553

(51) Int. Cl.
*A45D 34/04* (2006.01)
*B65D 47/42* (2006.01)
(Continued)

(52) U.S. Cl.
CPC ..... *A45D 34/042* (2013.01); *A45D 34/04* (2013.01); *A45D 34/043* (2013.01);
(Continued)

(58) Field of Classification Search
CPC .... A45D 34/042; A45D 34/041; B05C 17/00; B05C 17/002; B65D 47/248; B65D 47/42; B65D 83/46; B65D 83/48
(Continued)

(56) References Cited

U.S. PATENT DOCUMENTS 1,687,647 A * 10/1928 Garvey ..... B43K 5/1845 401/206
2,210,662 A * 8/1940 Garvey ..... B43K 5/1845 401/206
(Continued)

FOREIGN PATENT DOCUMENTS

CN 1288433 A 3/2001
CN 101415617 A 4/2009
(Continued)

OTHER PUBLICATIONS

International Search Report for International Application No. PCT/JP2016/086781 dated Jan. 17, 2017 (1 Sheet).
(Continued)

*Primary Examiner* — Vishal Pancholi
*Assistant Examiner* — Robert K Nichols, II
(74) *Attorney, Agent, or Firm* — Kratz, Quintos & Hanson, LLP

(57) ABSTRACT

A chemical solution supply apparatus (1) includes a container (10) and a chemical solution supply implement (20) that, in a state of being connected to a mouth portion (14), can switch over a state where the container (10) is sealed and a state where a chemical solution in a storage portion (12) is allowed to be supplied to the outside of the container (10). The chemical solution supply implement (20) has a base (30) and a supply body (50). The base (30) has a retaining portion (40), a pressing portion (42), and a restricting portion (34) that restricts displacement of the supply body
(Continued)

(50) with coming into contact with the supply body (50) when the supply body (50) is pressed against pressing force of the pressing portion (42). The supply body (50) moves away from the retaining portion (40) to thereby form a supply flow passage, and comes into contact with the retaining portion (40) to thereby block the supply flow passage.

13 Claims, 14 Drawing Sheets

(51) Int. Cl.

| | |
|---|---|
| ***B05C 17/00*** | (2006.01) |
| ***A61J 1/05*** | (2006.01) |
| ***A45D 40/26*** | (2006.01) |
| *A61J 1/14* | (2006.01) |
| *B65D 81/32* | (2006.01) |

(52) U.S. Cl.
CPC ..... *A45D 40/264* (2013.01); *A61J 1/05* (2013.01); *B05C 17/00* (2013.01); *B05C 17/002* (2013.01); *B65D 47/42* (2013.01); *A45D 2200/1009* (2013.01); *A45D 2200/1018* (2013.01); *A61J 1/1487* (2015.05); *B65D 81/3266* (2013.01)

(58) Field of Classification Search
USPC ..... 401/206, 214; 222/402.21–402.23, 222/495–497
See application file for complete search history.

(56) References Cited

U.S. PATENT DOCUMENTS

| | | | | |
|---|---|---|---|---|
| 2,975,466 | A | 3/1961 | Fillmore | |
| 3,263,265 | A | 8/1966 | Judson | |
| 3,336,626 | A | 8/1967 | Schaich | |
| 3,468,611 | A | 9/1969 | Ward | |
| 3,520,450 | A * | 7/1970 | Mason | B65D 83/34 222/94 |
| 3,690,515 | A * | 9/1972 | Ewald | B65D 83/682 222/136 |
| 4,089,609 | A * | 5/1978 | Gring | A45D 27/04 401/130 |
| 4,359,292 | A * | 11/1982 | Thompson | B65D 47/42 401/213 |
| 4,848,947 | A * | 7/1989 | Kremer | A46B 11/0013 401/206 |
| 5,056,949 | A | 10/1991 | Petrillo | |
| 5,897,267 | A * | 4/1999 | Poolman | A45D 34/041 401/208 |
| 6,179,505 | B1 * | 1/2001 | Oder, III | A45D 34/041 401/213 |
| 6,267,273 | B1 | 7/2001 | Suzuki | |
| 9,955,766 | B2 | 5/2018 | Bell | |
| 2004/0005186 | A1 | 1/2004 | Ueda | |
| 2009/0173755 | A1 | 7/2009 | Ogawa | |
| 2010/0084397 | A1 | 4/2010 | Kubo | |
| 2012/0034017 | A1 | 2/2012 | Archer | |

FOREIGN PATENT DOCUMENTS

| | | | |
|---|---|---|---|
| CN | 101541292 | A | 9/2009 |
| CN | 105073603 | A | 11/2015 |
| DE | 10211483 | A1 | 9/2003 |
| FR | 2799740 | A1 | 4/2001 |
| GB | 1515078 | A | 6/1978 |
| JP | S51-047562 | Y | 11/1976 |
| JP | H05-024574 | U | 3/1993 |
| JP | H08-207952 | A | 8/1996 |
| JP | H08217123 | A | 8/1996 |
| JP | 2002-160755 | A | 6/2002 |
| JP | 2005-132423 | A | 5/2005 |
| WO | 96/37126 | A1 | 11/1996 |

OTHER PUBLICATIONS

International Search Report for International Application No. PCT/JP2016/086782 dated Jan. 17, 2017 (2 Sheets).
Extended European Search Report for European Patent Application No. 16873129.7 dated Jul. 18, 2019 (11 sheets).
Extended European Search Report for European Patent Application No. 16873128.9 dated Jul. 22, 2019 (9 sheets).
Office Action of U.S. Appl. No. 15/781,921 dated Jan. 16, 2020 (20 sheets).

* cited by examiner

CHEMICAL SOLUTION SUPPLY APPARATUS AND CHEMICAL SOLUTION SUPPLY IMPLEMENT

TECHNICAL FIELD

The present invention relates to a chemical solution supply apparatus for supplying a chemical solution.

BACKGROUND ART

Chemical solution supply apparatuses for supplying a chemical solution to a part to be supplied, such as skin, have been known. For example, Patent Literature 1 discloses a chemical solution applicator including a container for containing a chemical solution, a plug body connected to the container, an inner lid connected to the plug body, and a sponge. The plug body is connected (press-fitted) to the mouth of the container. An outlet of the chemical solution is formed in the inner lid. An outlet portion of the inner lid surrounding the outlet is formed in a shape inclined so that the outlet gradually becomes smaller from the inside to the outside of the container. A spring and a movable valve are connected to the plug body. The spring urges the movable valve from the inside of the inner lid to the inner lid. The movable valve has a shoulder portion having a shape to have surface contact with the outlet portion and a protruding portion protruding from the shoulder portion toward the outside of the container. The outer shape of the protruding portion is set to be smaller than the outlet, and the protruding portion has a shape protruding to the outside from the outer surface of the inner lid. The outer edge of the sponge is fixed to the outer edge of the inner lid. The sponge is maintained in a shape that bulges to protrude outward by being urged by the protruding portion from the inside toward the outside.

The application of the chemical solution to skin using this chemical solution applicator is carried out in the following manner, for example. First, an outer surface of the sponge is pressed against the skin in a position with the outer surface facing downward. At this time, a gap is formed between the outlet portion and the shoulder portion by the protruding portion being pressed toward the inside of the inner lid against the urging force of the spring, so that the chemical solution in the container flows out to the outside of the inner lid through the outlet. This chemical solution is impregnated with the sponge. Thereafter, the chemical solution applicator in that state is moved sideways along the skin. As a result, the chemical solution held in the sponge is applied to the skin.

In the chemical solution supply apparatus as described in Patent Literature 1, clogging of the sponge may be caused by dirt on a part (such as skin) to be supplied adhering to the sponge, resulting in an insufficient supply amount of the chemical solution.

Thus, it is considered not to use (remove) the sponge. However, when the sponge is simply removed, the supply amount of the chemical solution becomes excessive. Specifically, the sponge has a function of being impregnated with (holding) the chemical solution and a function of supplying a substantially constant quantity of chemical solution to a part to be supplied (such as skin). Thus, when the sponge is removed, the whole quantity of the chemical solution flowing out through the outlet is supplied to a part to be supplied at a stroke. This is more conspicuous as the pressing amount of the movable valve increases.

CITATION LIST

Patent Literature

Patent Literature 1: Japanese Examined Utility Model Publication No. S51-47562

SUMMARY OF INVENTION

It is an object of the present invention to provide a chemical solution supply apparatus and a chemical solution supply implement which can achieve both the avoidance of insufficient supply of a chemical solution and the prevention of excessive supply of the chemical solution.

Means for Solving the Problem

A chemical solution supply apparatus according to one aspect of the present invention comprises a container having a storage portion for storing a chemical solution, a mouth portion joining the storage portion and opening in a specific direction, and a chemical solution supply implement which is connectable to the mouth portion and which is, in a state of being connected to the mouth portion, operable to switch over a state where the container is sealed and a state where the chemical solution in the storage portion is allowed to be supplied to the outside of the container. The chemical solution supply implement has a base connectable to the mouth portion and having a shape allowing communication between the inside of the container and the outside of the container, and a supply body held in the base for closing the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion to thereby form a supply flow passage of the chemical solution to the outside of the container between the supply body and the retaining portion, and comes into contact with the retaining portion to thereby block the supply flow passage.

A chemical solution supply implement according to another aspect of the present invention is connectable to a mouth portion of a container having a storage portion for storing a chemical solution and the mouth portion joining the storage portion and opening in a specific direction, and which is, in a state of being connected to the mouth portion, operable to switch over a state where the container is sealed and a state where the chemical solution in the storage portion is allowed to be supplied to the outside of the container. The chemical solution supply implement includes a base connectable to the mouth portion and having a shape allowing communication between the inside of the container and the outside of the container, and a supply body held in the base for closing the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion to thereby form a supply flow passage of the chemical solution to the outside of the container between the supply body and the retaining portion, and comes into contact with the retaining portion to thereby block the supply flow passage.

DESCRIPTION OF EMBODIMENTS

First Embodiment

A chemical solution supply apparatus 1 according to a first embodiment of the present invention will be described with reference to FIGS. 1 to 8.

Figure 1:
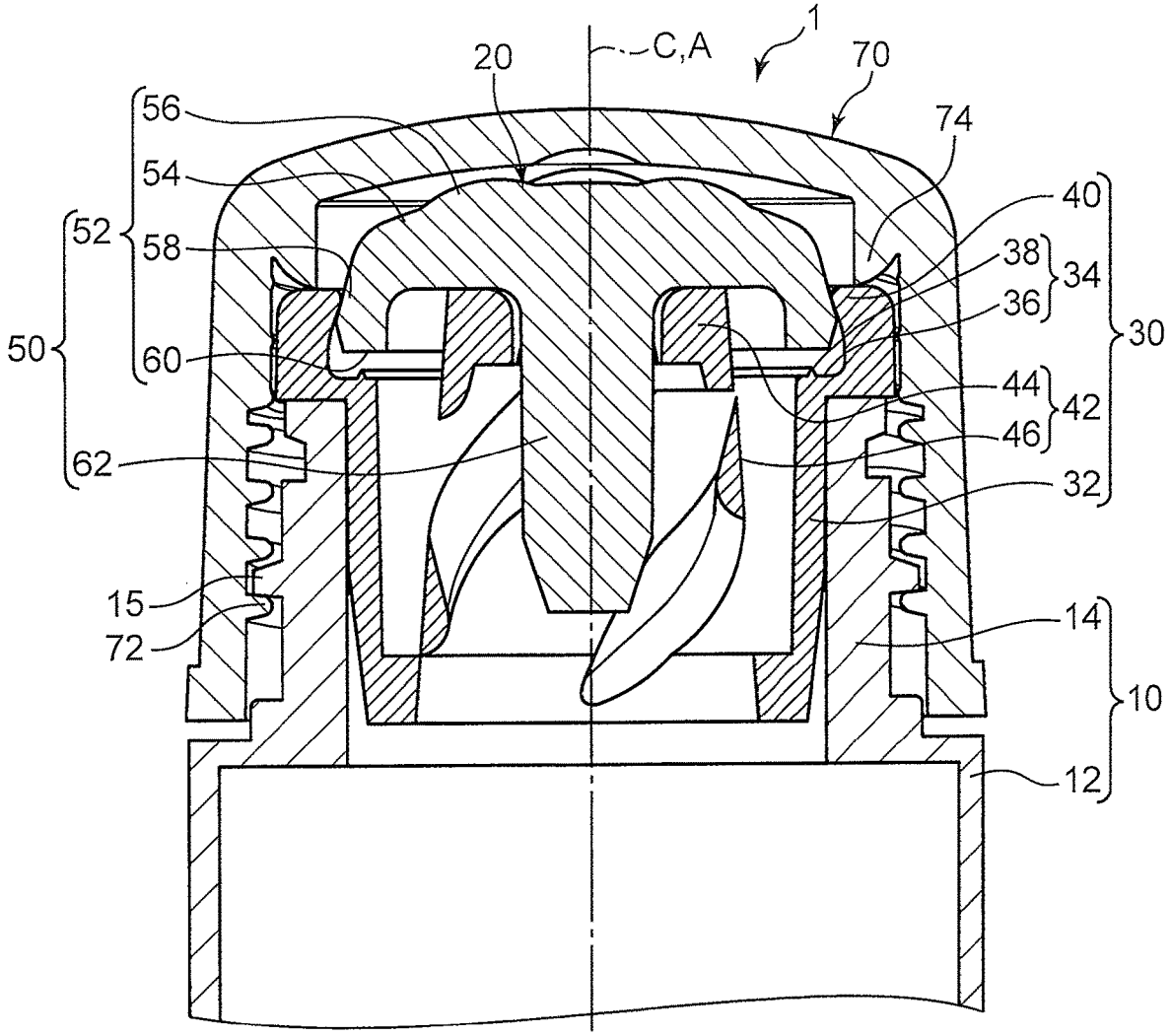
FIG. 1 is a cross-sectional view of a chemical solution supply apparatus according to a first embodiment of the present invention.

As shown in FIG. 1, the present chemical solution supply apparatus 1 includes a container 10, a chemical solution supply implement 20, and a cap 70.

The container 10 has a storage portion 12 for storing a chemical solution (not shown) and a mouth portion 14 joining the storage portion 12. The mouth portion 14 has a shape opening in a specific direction (vertical direction in FIG. 1). On an outer peripheral surface of the mouth portion 14, an external thread 15 is formed.

The chemical solution supply implement 20 is a unit that, in a state of being connected to the mouth portion 14, can switch over a state where the container 10 is sealed and a state where the chemical solution in the storage portion 12 is allowed to be supplied to the outside of the container 10. Specifically, the chemical solution supply implement 20 has a base 30 connectable to the mouth portion 14 and a supply body 50 held in the base 30.

The base 30 has a shape that, in a state of being connected to the mouth portion 14, allows communication between the inside of the container 10 and the outside of the container 10. The base 30 has a connected portion 32, a restricting portion 34, a retaining portion 40, and a pressing portion 42. In the present embodiment, the connected portion 32, the restricting portion 34, the retaining portion 40, and the pressing portion 42 are integrally molded. However, they may be formed as separate members.

The connected portion 32 is cylindrical. The outer diameter of the connected portion 32 is set to be slightly smaller than the inner diameter of the mouth portion 14.

The retaining portion 40 is positioned outside the container 10 when the connected portion 32 is connected (press-fitted) to the mouth portion 14. The retaining portion 40 comes into contact with the supply body 50 from the side opposite to the storage portion 12 with reference to the mouth portion 14 (upper side in FIG. 1) to prevent the detachment of the supply body 50 from the base 30. Specifically, the retaining portion 40 has a shape that comes into contact with the supply body 50 throughout the circumferential area around the central axis C of the connected portion 32.

The pressing portion 42 is connected to the inside of the connected portion 32, and presses the supply body 50 against the retaining portion 40. The pressing portion 42 has a holding portion 44 for holding the supply body 50 and an urging portion 46 for urging the holding portion 44 toward the outside of the container 10.

Figure 2:
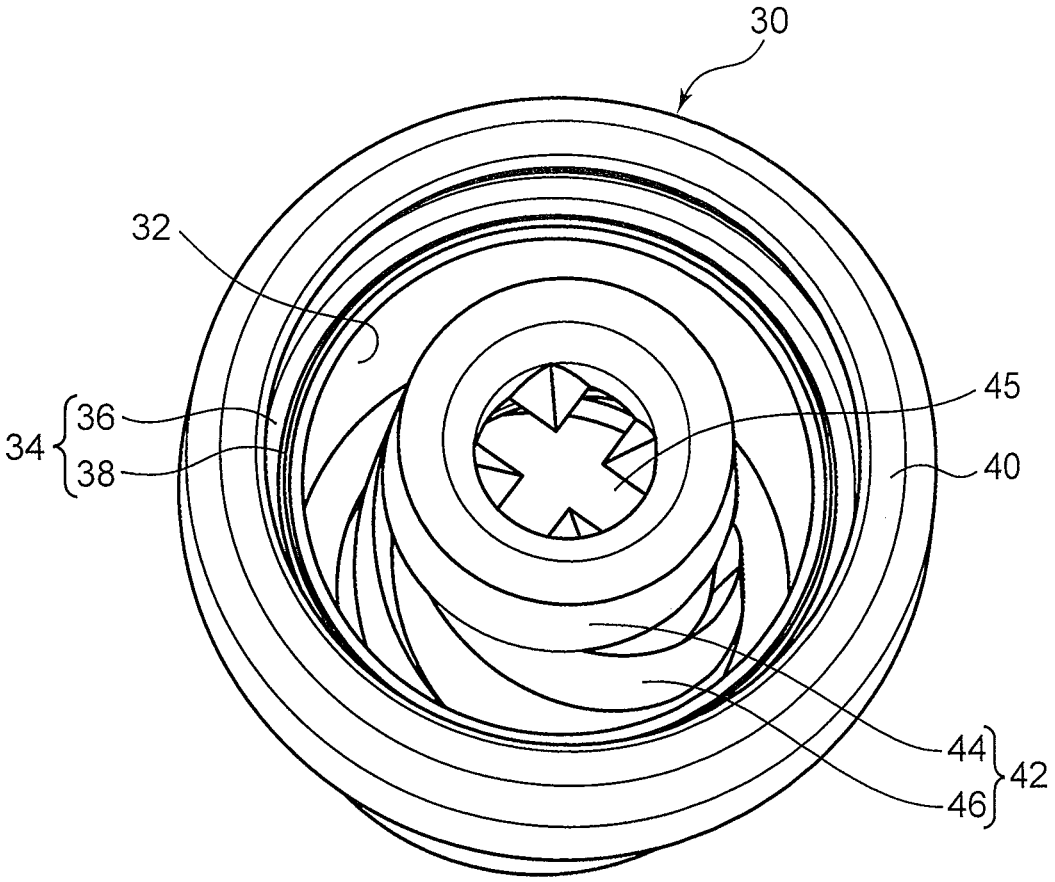
FIG. 2 is a perspective view of a base of the chemical solution supply apparatus shown in FIG. 1.

The holding portion 44 is displaceable along the central axis C inside the connected portion 32, in a state of holding the supply body 50. Specifically, the outer diameter of the holding portion 44 is smaller than the inner diameter of the connected portion 32. The holding portion 44 holds the supply body 50 in such a manner as to restrict the rotation of the supply body 50 around the central axis C that is parallel to the direction of action (upward in FIG. 1) of the urging force of the urging portion 46. In the present embodiment, as shown in FIG. 2, a cross-shaped groove 45 is formed in the holding portion 44. By inserting a shaft portion 62 to be described later of the supply body 50 into the groove 45, the relative rotation of the supply body 50 with respect to the base 30 is restricted.

Figure 3:
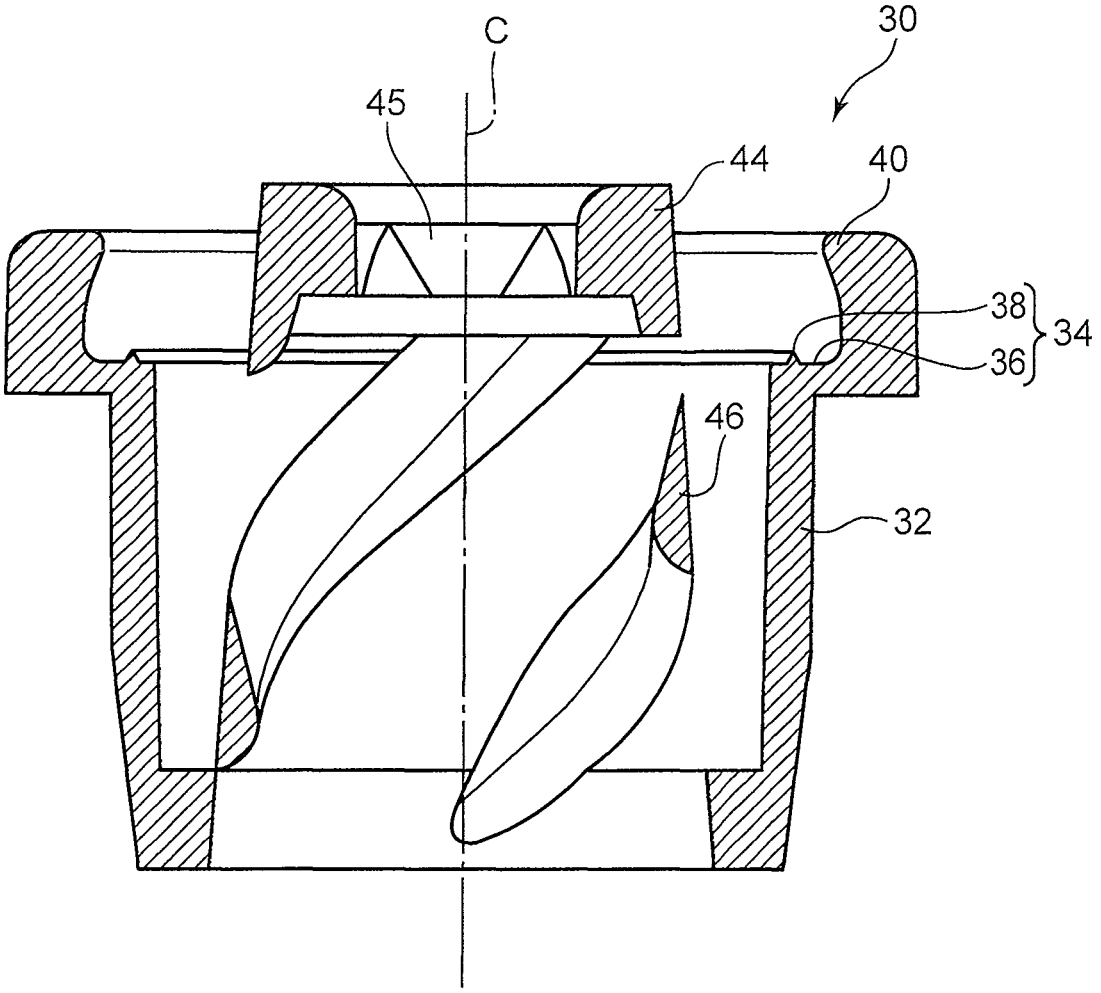
FIG. 3 is a cross-sectional view of the base of the chemical solution supply apparatus shown in FIG. 1.

The urging portion 46 is a helical spring member that connects an end portion of the inner peripheral surface of the connected portion 32 close to the storage portion 12 (on the lower side in FIG. 1) to the holding portion 44. The expansion and contraction of the urging portion 46 causes the holding portion 44, that is, the supply body 50 to be displaced in the direction parallel to the direction of action of the urging force of the urging portion 46. As shown in FIG. 3, the urging portion 46 at the natural length connects the connected portion 32 and the holding portion 44 so that the upper end face of the holding portion 44 is positioned above the retaining portion 40. As shown in FIG. 1, the urging portion 46 is compressed from the natural length in a state where the supply body 50 is in contact with the retaining portion 40. In other words, the urging portion 46 presses the supply body 50 against the retaining portion 40 at all times. FIG. 1 shows a state where the container 10 is sealed by the supply body 50 being pressed against the retaining portion 40.

The restricting portion 34 is formed between the connected portion 32 and the retaining portion 40. When the supply body 50 is pressed against the pressing force of the pressing portion 42, the restricting portion 34 comes into contact with the supply body 50, thereby restricting the displacement of the supply body 50. The restricting portion 34 has an annular restricting surface 36 orthogonal to the central axis C of the connected portion 32, and an annular protrusion 38 protruding outward from the restricting surface 36 and having a shape that is annular and has line contact with the supply body 50. It should be noted that the annular protrusion 38 may be omitted.

The supply body 50 is held in the base 30, and is operable to close the container 10 and supply the chemical solution to a part to be supplied (such as skin). Specifically, the supply body 50 has a supply body main body 52 and a shaft portion 62. The supply body main body 52 and the shaft portion 62 are integrally molded.

The supply body main body 52 has a supply surface 54 for supplying the chemical solution to a part to be supplied, a plurality of (three in the present embodiment) bulging portions 56, an abutting portion 58 to come into contact with the retaining portion 40, and an opposed portion 60 to be opposed to the restricting portion 34.

The supply surface 54 has a shape curved to protrude toward the outside of the container 10.

Figure 4:
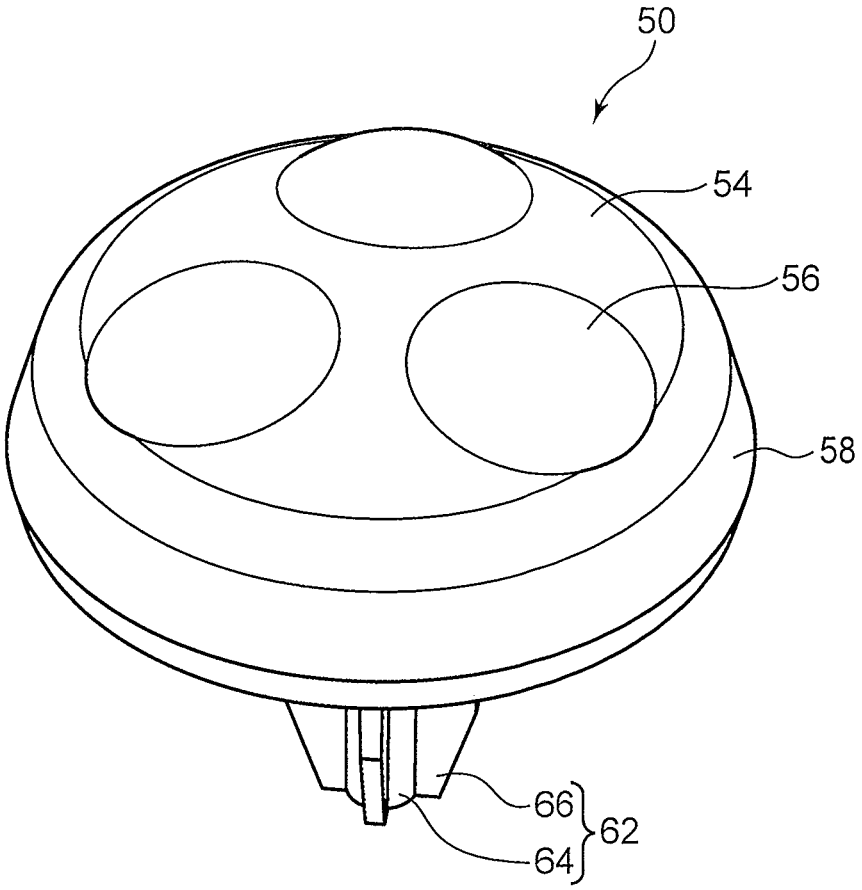
FIG. 4 is a perspective view of a supply body of the chemical solution supply apparatus shown in FIG. 1.
Figure 5:
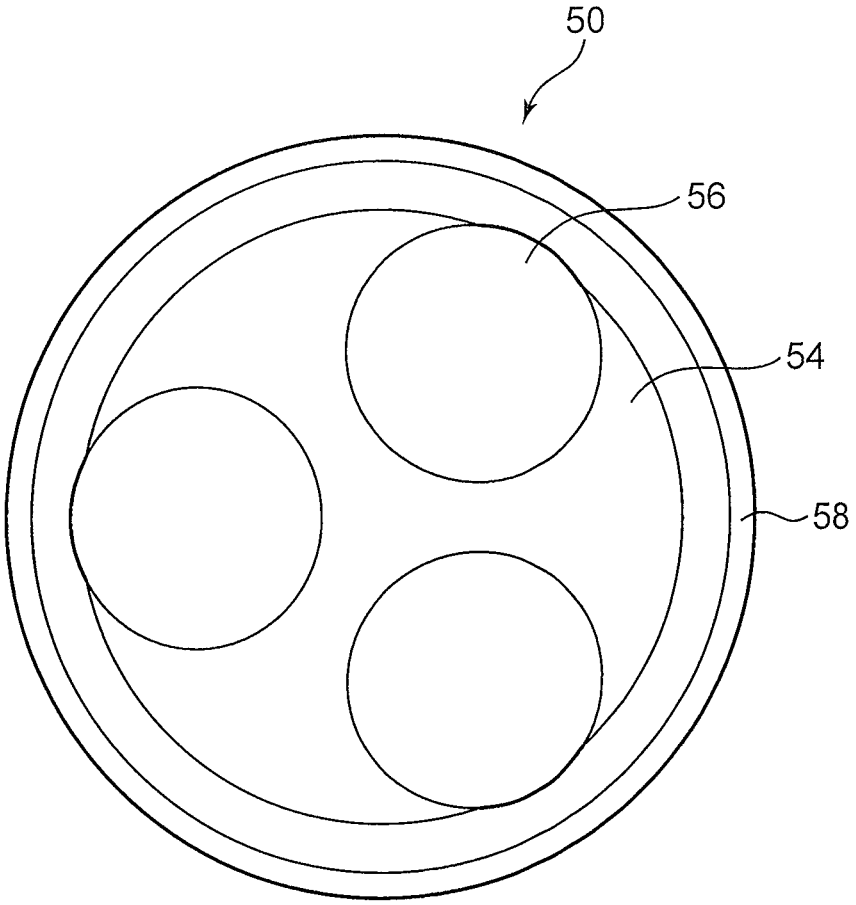
FIG. 5 is a plan view of the supply body of the chemical solution supply apparatus shown in FIG. 1.

Each bulging portion 56 has a shape bulging outward from the supply surface 54. In other words, the radius of curvature of each bulging portion 56 is set to be smaller than the radius of curvature of the supply surface 54. As shown in FIGS. 4 and 5, each bulging portion 56 is formed at a part of the supply surface 54 away from the center of the supply surface 54. In the present embodiment, the bulging portions 56 are arranged so as to be evenly spaced around the center.

Figure 7:
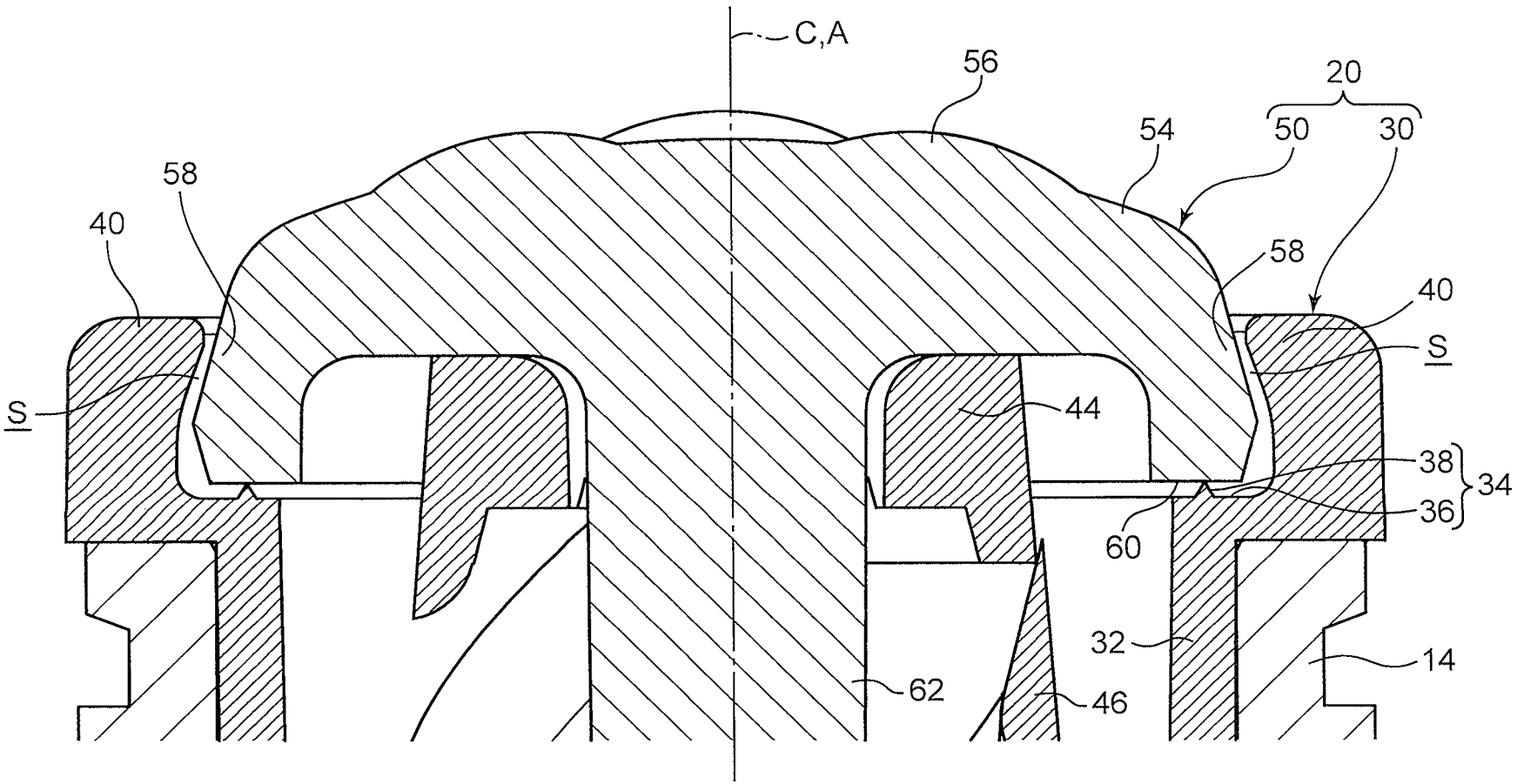
FIG. 7 is a cross-sectional view of a state where the supply body is pressed in the chemical solution supply apparatus shown in FIG. 1.

The abutting portion 58 comes into contact with the retaining portion 40 in the direction of action of the urging force (pressing force). The abutting portion 58 is connected to the outer edge of the supply surface 54. The abutting portion 58 is formed in a shape in which the outer diameter of the abutting portion 58 gradually increases with distance from the supply surface 54 (truncated cone shape). As shown in FIG. 7, the abutting portion 58 moves away from the retaining portion 40 to thereby form a supply flow passage S of the chemical solution to the outside of the container 10 between the supply body 50 and the retaining portion 40. In this state, the chemical solution is allowed to be supplied to a part to be supplied. As shown in FIG. 1, the abutting portion 58 comes into contact with (close contact with) the retaining portion 40 to thereby block the supply flow passage S. In this state, the container 10 is sealed.

Figure 6:
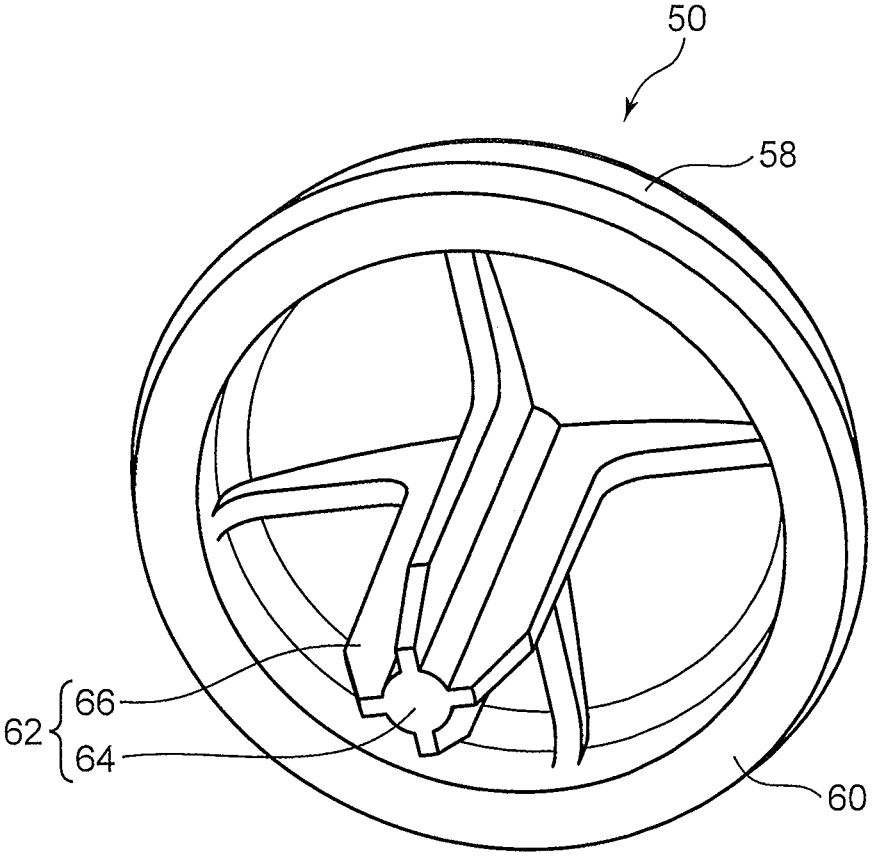
FIG. 6 is a perspective view of the supply body at an angle different from that in FIG. 4.

The shaft portion 62 has a shape extending from the surface of the supply body main body 52 opposite to the supply surface 54, perpendicularly to the surface. As shown in FIGS. 4 and 6, the shaft portion 62 has a central shaft 64 and a plurality of (four in the present embodiment) side plates 66.

The central shaft 64 is cylindrical. The central shaft 64 is set to have an outer diameter insertable into the groove 45 of the holding portion 44.

Each of the side plates 66 has a shape protruding from the central shaft 64 outward in the radial direction of the central shaft 64. Each of the side plates 66 is disposed at intervals of 90 degrees along the circumferential direction of the central shaft 64. Each of the side plates 66 is set to have a thickness insertable into the groove 45. By inserting these side plates 66 into the groove 45, the relative rotation of the supply body 50 around the central axis C with respect to the base 30 is restricted. Note that the term "restrict" as used herein does not mean not permitting relative rotation of the supply body 50 with respect to the base 30 at all, but rather means that the relative rotation is restricted such that the amount of displacement of the supply body 50 in the circumferential direction falls within a preset tolerance.

The opposed portion 60 is a part opposed to the restricting portion 34 in a state where the shaft portion 62 is inserted into the groove 45. The opposed portion 60 is formed flat. As shown in FIG. 7, when the supply surface 54 or the bulging portions 56 are pressed against the urging force of the urging portion 46, the opposed portion 60 comes into contact (line contact) with the annular protrusion 38 of the restricting portion 34. In this state, the outflow of the chemical solution to the outside of the container 10 is restricted.

Figure 8:
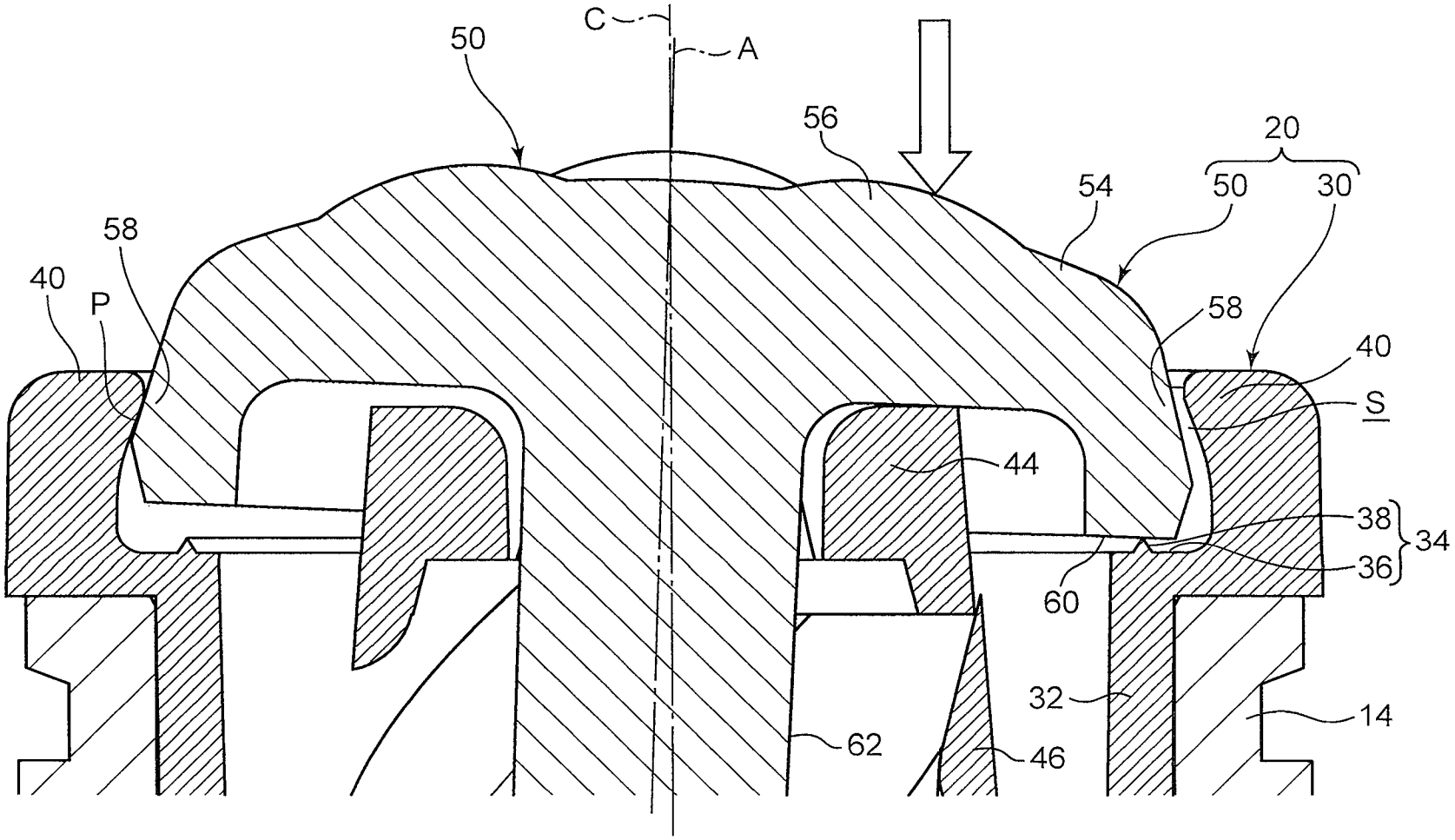
FIG. 8 is a cross-sectional view of a state where the supply body is inclined in the chemical solution supply apparatus shown in FIG. 1.

As shown in FIG. 8, the retaining portion 40 has a shape that allows the supply body 50 to incline in such a way that the central axis A of the shaft portion 62 inclines with respect to the central axis C. Specifically, the retaining portion 40 has a shape that, when an off-center portion (e.g. one bulging portion 56) of the supply body 50 away from the central axis A in a direction at right angles to the central axis A is pressed, allows the supply body 50 to tilt with respect to the base 30 until the opposed portion 60 comes into contact with the annular protrusion 38 with a contact point P between a part of the supply body 50 located opposite to the off-center portion with reference to the central axis A and the retaining portion 40 as a supporting point.

The cap 70 is screwed onto the mouth portion 14. Specifically, on an inner peripheral surface of the cap 70, an internal thread 72 to be engaged with the external thread 15 formed on the mouth portion 14 is formed. In addition, the cap 70 has an annular protruding portion 74 that comes into contact with the retaining portion 40, thereby sealing the container 10.

Next, a method of using the chemical solution supply apparatus 1 will be described. Hereinafter, the case where a part to be supplied is skin, that is, the case where the chemical solution is applied to skin using the present chemical solution supply apparatus 1 will be described.

First, the supply surface 54 is pressed against the skin in a position in which the supply surface 54 faces downward. At this time, the supply body 50 is pressed against the urging force of the urging portion 46 until the opposed portion 60 comes into contact with the annular protrusion 38. As a result, as shown in FIG. 7, the supply flow passage S is formed between the abutting portion 58 and the retaining portion 40, so that the chemical solution in the container 10 is supplied to the outside of the container 10 through the supply flow passage S. On the other hand, since the container 10 is sealed by the contact between the annular protrusion 38 and the opposed portion 60, further supply of the chemical solution is stopped.

Then, by moving the chemical solution supply apparatus 1 in that state along the skin, the chemical solution is applied to a desired area of the skin.

As described above, the present chemical solution supply apparatus 1 supplies the chemical solution through the supply flow passage S when the supply body 50 is pressed against the urging force of the urging portion 46, thus avoiding insufficient supply of the chemical solution. Further, the displacement (pressing stroke) of the supply body 50 is restricted by the supply body 50 coming into contact with the restricting portion 34, and thus excessive supply of the chemical solution through the supply flow passage S is prevented. Consequently, it is possible to keep the supply amount of the chemical solution within a certain range.

Further, in the present embodiment, since the restricting portion 34 has the annular protrusion 38 that has line contact with the opposed portion 60, the outflow of the chemical solution is effectively restricted by the opposed portion 60 coming into contact with the annular protrusion 38. Consequently, excessive supply of the chemical solution is prevented more reliably.

Further, since the holding portion 44 holds the supply body 50 to restrict the rotation of the supply body 50 around the central axis C parallel to the direction of action of the urging force, wear on the annular protrusion 38 is reduced. For example, if the supply body 50 is relatively rotatable with respect to the holding portion 44, the relative rotation of the supply body 50 with respect to the holding portion 44 in a state where the supply body 50 is in contact with the annular protrusion 38 causes wear on the annular protrusion 38. However, the present chemical solution supply apparatus 1 restricts the relative rotation of the supply body 50 with respect to the holding portion 44, thus reducing wear on the annular protrusion 38.

Further, since the retaining portion 40 has a shape that allows the supply body 50 to be incline in such a way that the central axis A of the shaft portion 62 inclines with respect to the central axis C, even when the off-center portion of the supply body 50 is pressed, the supply flow passage S is provided, whereby the chemical solution can be smoothly supplied.

Further, since the relative rotation of the supply body 50 with respect to the holding portion 44 is restricted, an external force acting on the off-center portion of the supply body 50 tends to act as a pressing force in a direction to incline the supply body 50. Consequently, the supply body 50 is inclined easily, so that an effective amount of supply of the chemical solution is provided.

In addition, since each bulging portion 56 is formed at a part of the supply surface 54 away from the center of the supply surface 54, the bulging portion 56 when pressed facilitates the inclination of the supply body 50, whereby the supply flow passage S is effectively formed.

Second Embodiment

Next, a chemical solution supply apparatus 1 according to a second embodiment of the present invention will be described with reference to FIGS. 11 to 14. In the present embodiment, only the portions different from the first embodiment will be described, and the description of the same structure, action, effect, and the like as in the first embodiment will be omitted.

In the present embodiment, the bulging amount of the bulging portions 56 from the supply surface 54 is set to be larger than that of the first embodiment. Three reinforcing ribs 61 are formed on the back side of the bulging portions 56 (lower side in FIG. 11), more specifically, in positions overlapping with the bulging portions 56 in a direction parallel to the direction of action of the pressing force. The bulging portions 56 are formed inside the annular protrusion 38 in the radial direction of the annular protrusion 38. This also applies to the first embodiment.

The length of the shaft portion 62 is set to be shorter than that of the first embodiment.

Figure 11:
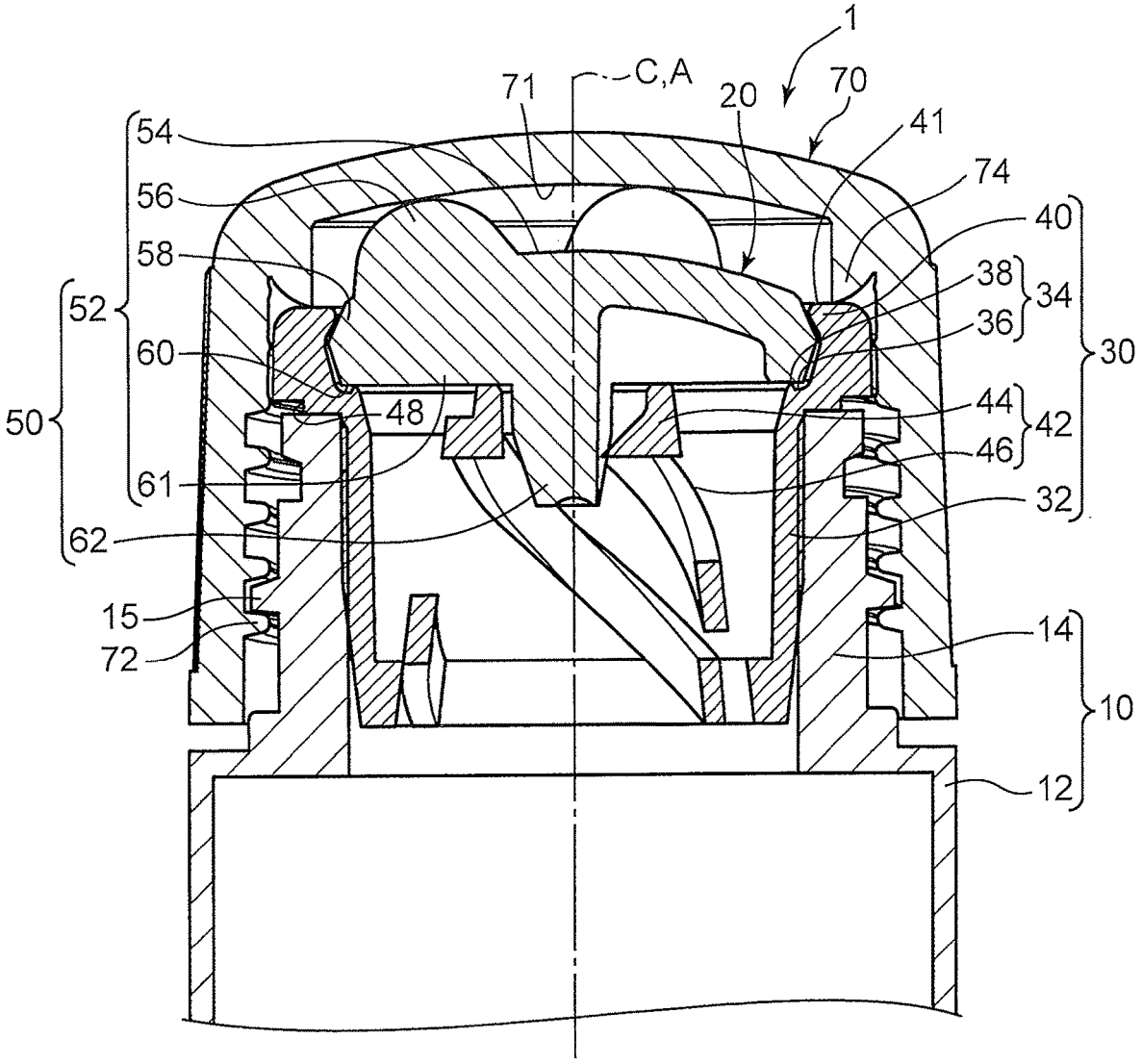
FIG. 11 is a cross-sectional view of a chemical solution supply apparatus according to a second embodiment of the present invention.
Figure 12:
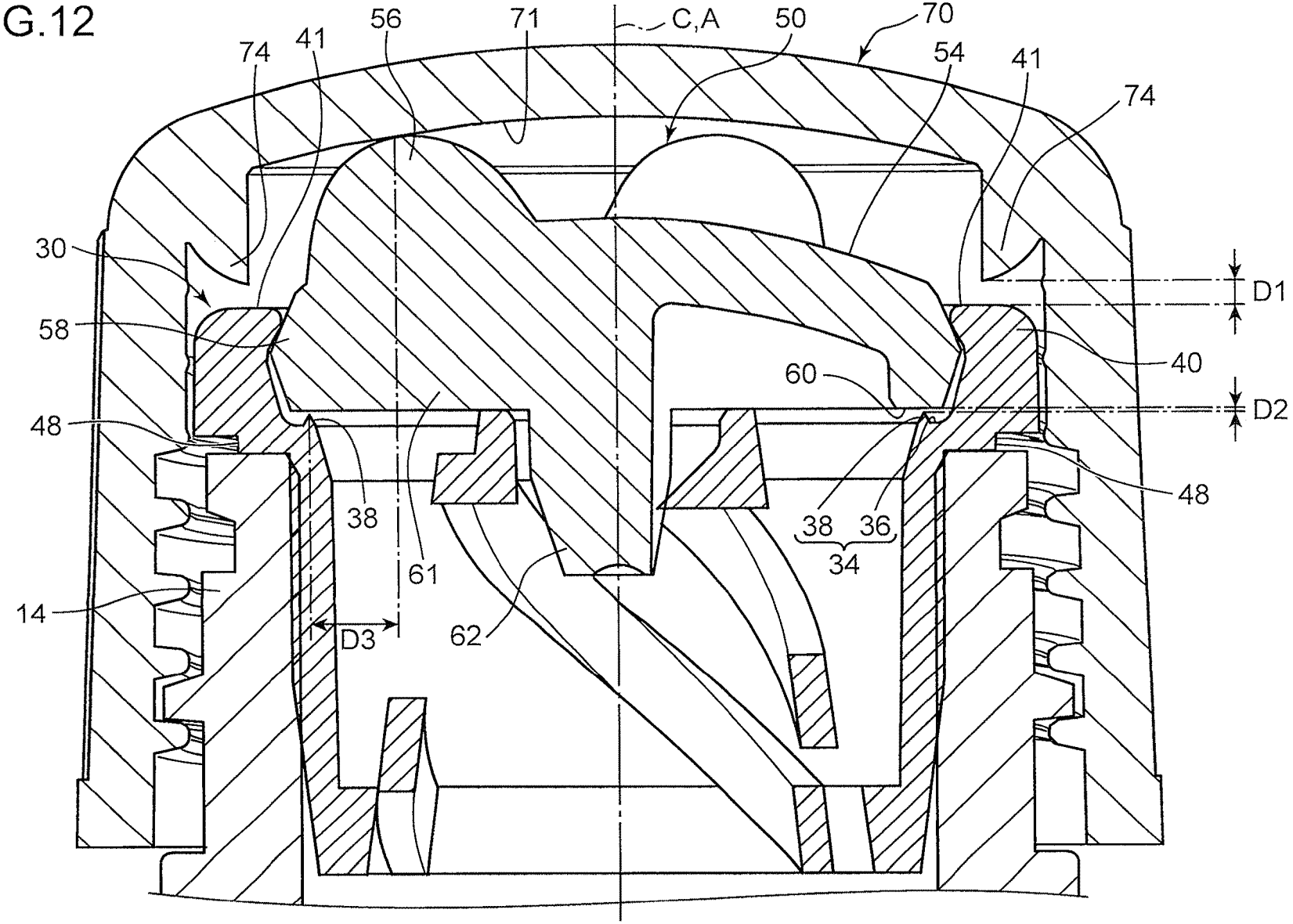
FIG. 12 is a cross-sectional view when a pressing surface of a cap comes into contact with bulging portions.
Figure 13:
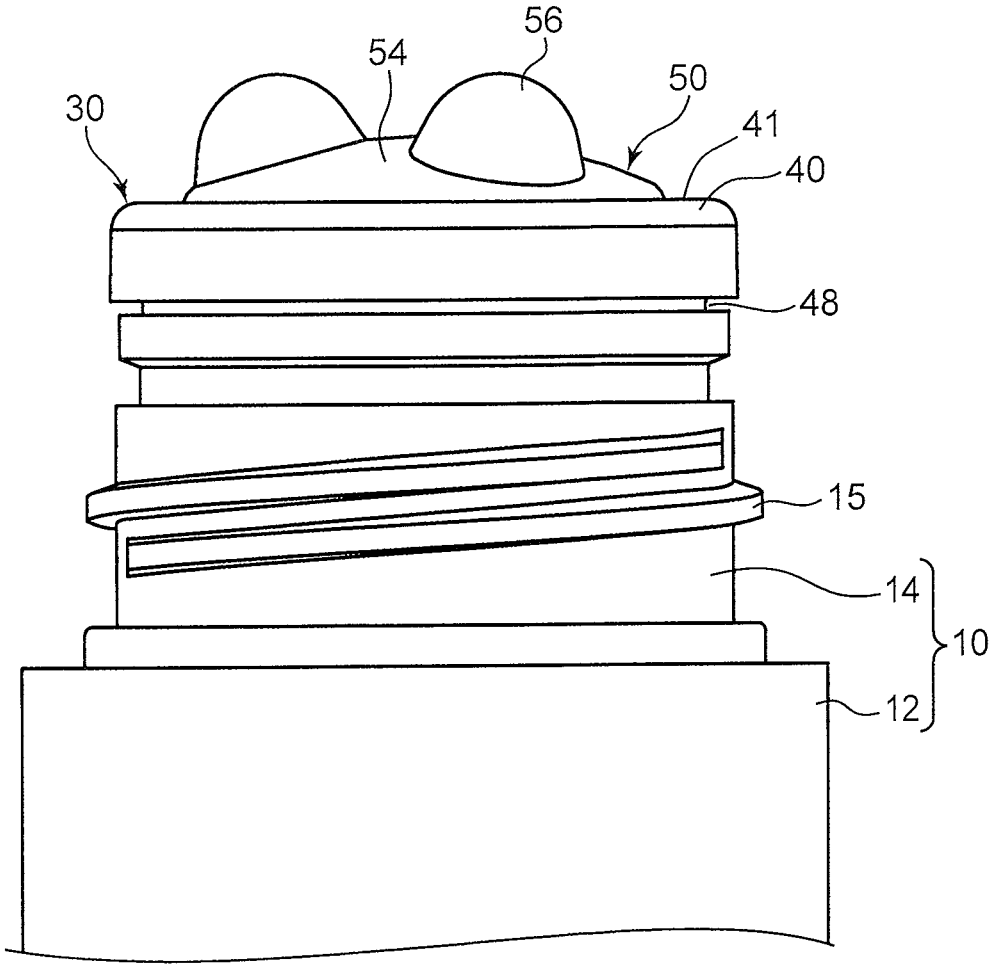
FIG. 13 is a side view showing a state where the cap is removed from the chemical solution supply apparatus shown in FIG. 11.
Figure 14:
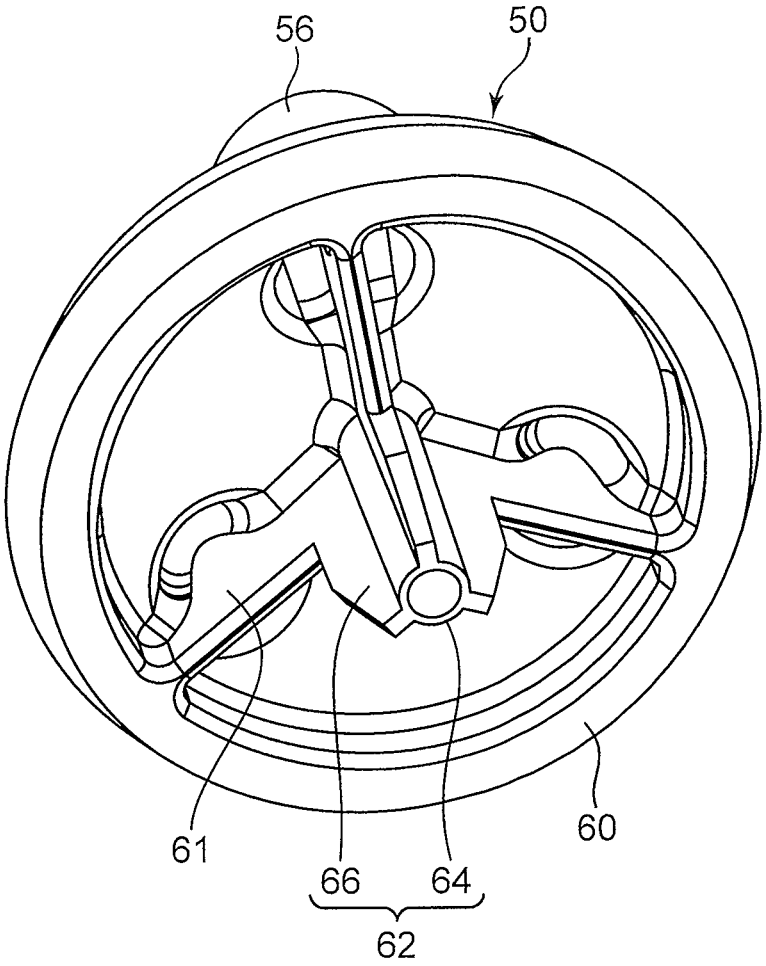
FIG. 14 is a perspective view of a supply body of the chemical solution supply apparatus shown in FIG. 11.

As shown in FIGS. 11 to 13, at an outer peripheral surface of the retaining portion 40, a chemical solution holding portion 48 for holding the chemical solution is formed. The chemical solution holding portion 48 has a shape that is recessed inward in the radial direction (the right and left direction in FIG. 11) of the retaining portion 40 from the other part of the outer peripheral surface of the retaining portion 40, and is continuous in the circumferential direction of the retaining portion 40. That is, the chemical solution holding portion 48 holds the chemical solution using a capillary phenomenon.

In the present embodiment, the cap 70 has a pressing surface 71 for pressing the supply body 50 so that the opposed portion 60 of the supply body 50 comes into contact with the annular protrusion 38 of the restricting portion 34 in a state where the cap 70 is connected (screwed) to the mouth portion 14. In other words, the bulging amount of the bulging portions 56 is set so that the opposed portion 60 is pressed against the annular protrusion 38 when the cap 70 is connected to the mouth portion 14.

In the present embodiment, the protruding portion 74 has a function of restricting the pressing amount of the pressing surface 71 against the supply body 50 in a state where the cap 70 is connected to the mouth portion 14. That is, in the present embodiment, the protruding portion 74 functions as a "stopper". The upper surface of the retaining portion 40 corresponds to a receiving portion 41 that receives the stopper.

FIG. 12 shows the moment when the pressing surface 71 comes into contact with the bulging portions 56 of the supply body 50 in the process of connecting (screwing) the cap 70 to the mouth portion 14. As shown in FIG. 12, the distance D 1 between the stopper (protruding portion 74) and the receiving portion 41 when the pressing surface 71 comes into contact with the bulging portions 56 is larger than the distance D2 between the opposed portion 60 and the annular protrusion 38 when the pressing surface 71 comes into contact with the bulging portions 56. The distance D3 in the radial direction of the annular protrusion 38 from a contact portion (including point contact and surface contact) between the bulging portion 56 formed at the position closest to the central axis of the annular protrusion 38 among the bulging portions 56 and the pressing surface 71 to the annular protrusion 38 is preferably 0.1 or more times and 180 or less times, and more preferably 0.1 or more times and 90 or less times than the difference between the distance D1 between the stopper and the receiving portion 41 and the distance D2 between the opposed portion 60 and the annular protrusion 38 when the bulging portion 56 comes into contact with the pressing surface 71.

In the present embodiment, the base 30 is formed of a polyacetal resin (POM). As a result, the plastic deformation (reduction in urging force) of the urging portion 46 is prevented. The supply body 50 may also be formed of a polyacetal resin. However, it is preferable that the supply body 50 be formed of a resin material having a lower hardness than the polyacetal resin forming the base 30. In the present embodiment, since the ribs 61 are provided on the back side of the bulging portions 56, occurrence of sink marks on the bulging portions 56 when the supply body 50 is molded with the resin is prevented. Further, by providing the ribs 61 on the back side of the bulging portions 56, deformation of the supply surface 54 when the pressing force caused by the contact between the bulging portions 56 and the pressing surface 71 acts on the bulging portions 56 can be effectively prevented, compared to the case where the ribs 61 are provided out of alignment with the bulging portions 56, so that breakage (cracking or the like) of the supply surface 54 is prevented.

As described above, since the chemical solution supply apparatus 1 of the present embodiment has the chemical solution holding portion 48 formed at the outer peripheral surface of the retaining portion 40, even when the chemical solution leaks to the outside of the supply body 50, the chemical solution is held in the chemical solution holding portion 48. Consequently, the chemical solution leaking to the outside of the supply body 50 is prevented from reaching the outer peripheral surface of the storage portion 10.

Since the chemical solution holding portion 48 has a shape that is recessed inward in the radial direction of the retaining portion 40 from the other part of the outer peripheral surface of the retaining portion 40, and is continuous in the circumferential direction of the retaining portion 40, the chemical solution that has leaked to the outside of the supply body 50 is effectively held in the chemical solution holding portion 48 by the capillary phenomenon.

It is to be understood that the embodiments disclosed this time are illustrative in all respects and are not limiting. The scope of the present invention is defined not by the description of the above embodiments but by the scope of the claims, and further includes all changes within meaning and scope equivalent to the scope of the claims.

For example, as long as the relative rotation of the supply body 50 around the central axis with respect to the base 30 is restricted, the shape of the groove 45 of the holding portion 44 and the shape of the shaft portion 62 are not limited to the above example.

Figure 9:
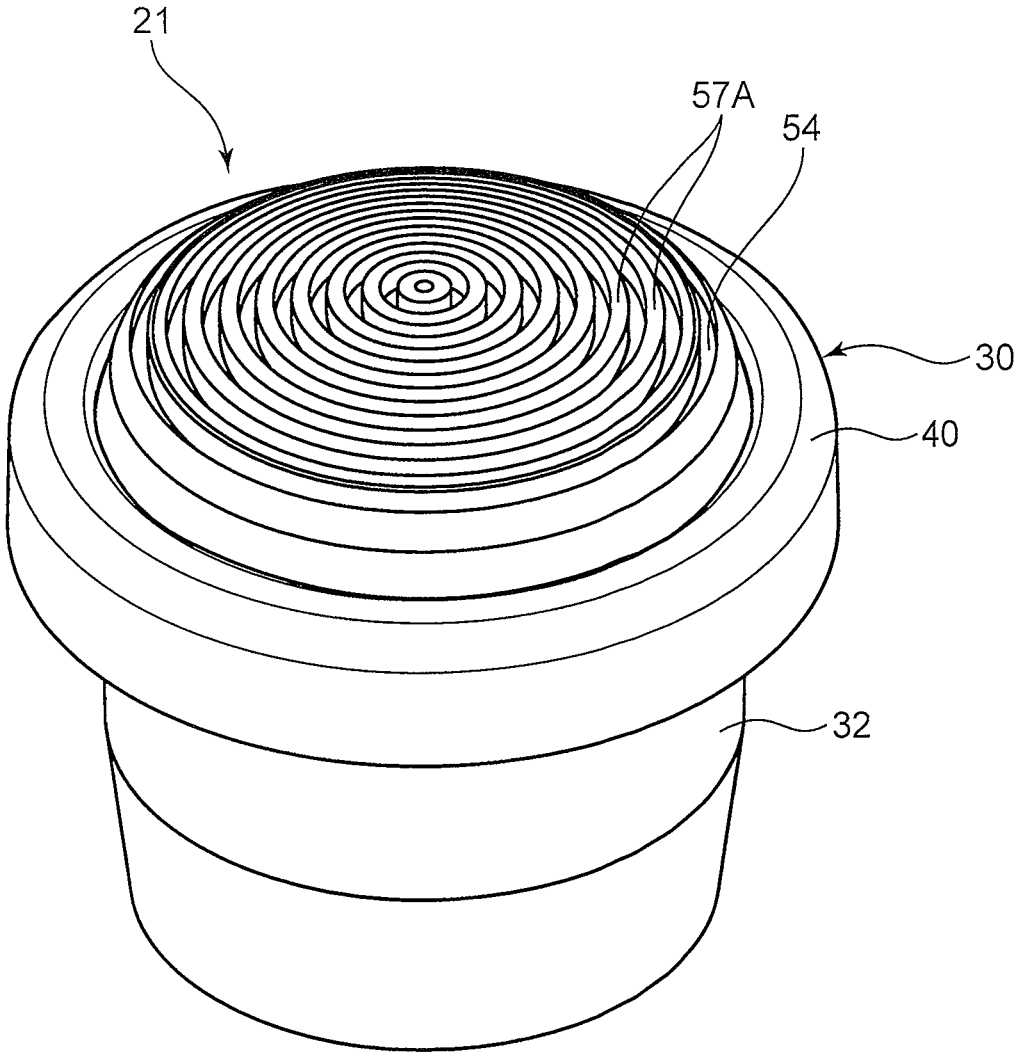
FIG. 9 is a perspective view of a first modification of a chemical solution supply implement.

FIG. 9 shows a first modification of the chemical solution supply implement 20 of the above embodiments. The chemical solution supply implement 21 has a resistance generating portion 57A formed on the supply surface 54. The resistance generating portion 57A makes the frictional resistance between the resistance generating portion 57A and a part to be supplied higher than the frictional resistance between the supply surface 54 and the part to be supplied. In this example, the resistance generating portion 57A is composed of a plurality of cylinders disposed concentrically around the central axis A. In this mode, when the chemical solution supply apparatus is moved along a part (skin) to be supplied from the state where the supply body 50 is pressed against the part to be supplied, the frictional resistance between the resistance generating portion 57A and the part to be supplied is higher than the frictional resistance between the supply surface 54 and the part to be supplied, so that the supply body 50 tends to be inclined with respect to the base 30. Consequently, the supply flow passage S is effectively formed. Further, the resistance generating portion 57A has a function of holding the chemical solution between the cylinders and a function of alleviating itching of the skin by stimulating the skin.

Figure 10:
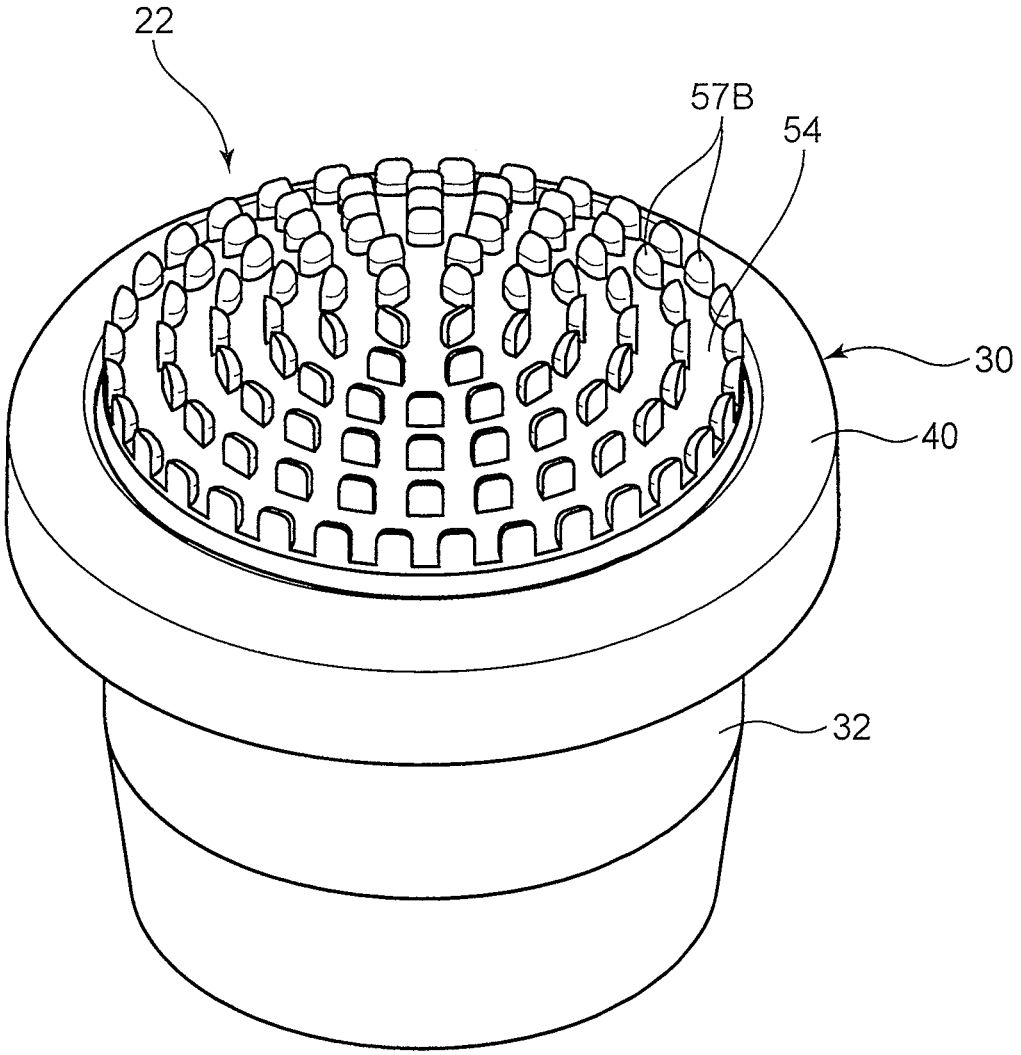
FIG. 10 is a perspective view of a second modification of the chemical solution supply implement.

FIG. 10 shows a second modification of the chemical solution supply implement 20 of the above embodiments. This chemical solution supply implement 22 also has a resistance generating portion 57B provided on the supply surface 54. In this example, the resistance generating portion 57B is composed of a plurality of small protrusions each protruding from the supply surface 54. Also in this mode, the same effect as that of the chemical solution supply implement 21 shown in FIG. 9 can be obtained.

The embodiments described above include the invention having the following configuration.

A chemical solution supply apparatus in the above embodiments includes a container having a storage portion operable to store a chemical solution and a mouth portion joining the storage portion and opening in a specific direction, and a chemical solution supply implement which is connectable to the mouth portion, and which is, in a state of being connected to the mouth portion, operable to switch over a state where the container is sealed and a state where the chemical solution in the storage portion is allowed to be supplied to the outside of the container. The chemical solution supply implement has a base connectable to the mouth portion and having a shape allowing communication between the inside of the container and the outside of the container, and a supply body held in the base for closing the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion to thereby form a supply flow passage of the chemical solution to the outside of the container between the supply body and the retaining portion, and comes into contact with the retaining portion to thereby block the supply flow passage.

In the present chemical solution supply apparatus, when the supply body is pressed against the pressing force of the pressing portion, the chemical solution is supplied through the supply flow passage, so that insufficient supply of the chemical solution is avoided. Further, since the displacement (pressing stroke) of the supply body is restricted by the supply body coming into contact with the restricting portion, excessive supply of the chemical solution through the supply flow passage is prevented. Consequently, it is possible to keep the supply amount of the chemical solution within a certain range.

In the chemical solution supply apparatus, the restricting portion preferably has an annular restricting surface orthogonal to a direction of action of the pressing force, and an annular protrusion protruding outward from the restricting surface and having a shape that is annular and has line contact with the supply body.

In this way, the outflow of the chemical solution is effectively restricted by the supply body coming into contact with the annular protrusion, so that excessive supply of the chemical solution is prevented more reliably.

In this case, the pressing portion preferably has a holding portion that holds the supply body to restrict rotation of the supply body around a central axis parallel to the direction of action of the pressing force.

In this way, wear on the annular protrusion is reduced. For example, if the supply body is relatively rotatable with respect to the holding portion, wear on the annular protrusion occurs when the supply body is relatively rotated with respect to the holding portion in a state where the supply body is in contact with the annular protrusion. However, the present chemical solution supply apparatus restricts the relative rotation of the supply body with respect to the holding portion, so that wear on the annular protrusion is reduced. Note that the term "restrict" as used herein does not mean not permitting relative rotation of the supply body with respect to the holding portion at all, but rather means that the relative rotation is restricted such that the amount of circumferential displacement of the supply body falls within a preset tolerance.

In the chemical solution supply apparatus, the retaining portion preferably has a shape that allows, when an off-center portion of the supply body away from a central axis parallel to a direction of action of the pressing force in a direction at right angles to the central axis is pressed, the supply body to tilt with respect to the base until the supply body comes into contact with the restricting portion with a contact point between a part of the supply body located opposite to the off-center portion with reference to the central axis and the retaining portion as a supporting point.

This allows the chemical solution to be smoothly supplied even when the off-center portion of the supply body is pressed. Specifically, the retaining portion has a shape that, when the off-center portion is pressed, allows the supply body to tilt with respect to the base until the supply body comes into contact with the restricting portion with the contact point between the supply body and the retaining portion as a supporting point, so that a supply flow passage is provided.

Further, in the chemical solution supply apparatus, the supply body preferably has a supply surface operable to come into contact with the part to be supplied, and at least one bulging portion formed at a part of the supply surface around a central axis parallel to a direction of action of the pressing force, and having a shape bulging outward from the supply surface.

This facilitates the inclination of the supply body when the bulging portion is pressed, so that the supply flow passage is effectively formed.

The chemical solution supply apparatus preferably further includes a chemical solution holding portion formed at at least one of an outer peripheral surface of the retaining portion and an outer peripheral surface of the mouth portion, for holding the chemical solution.

In this way, if the chemical solution leaks to the outside of the supply body, the chemical solution is held in the chemical solution holding portion. Consequently, the chemical solution leaking to the outside of the supply body is prevented from reaching the outer peripheral surface of the storage portion.

Specifically, it is preferable that the chemical solution holding portion be formed at the outer peripheral surface of the retaining portion, and the chemical solution holding portion have a shape recessed inward in a radial direction of the retaining portion from the other part of the outer peripheral surface of the retaining portion and continuous in a circumferential direction of the retaining portion.

This allows the chemical solution that has leaked to the outside of the supply body to be held more reliably in the chemical solution holding portion, so that the chemical solution is more reliably prevented from reaching the outer peripheral surface of the storage portion.

A chemical solution supply implement in the above embodiments is connectable to a mouth portion of a container having a storage portion for storing a chemical solution and the mouth portion joining the storage portion and opening in a specific direction, and which is, in a state of being connected to the mouth portion, operable to switch over a state where the container is sealed and a state where the chemical solution in the storage portion is allowed to be supplied to the outside of the container. The chemical solution supply implement includes a base connectable to the mouth portion and having a shape allowing communication between the inside of the container and the outside of the container, and a supply body held in the base for closing the container and supplying the chemical solution to a part to be supplied. The base has a retaining portion that comes into contact with the supply body from a side opposite to the storage portion with reference to the mouth portion to prevent detachment of the supply body from the base, a pressing portion that presses the supply body to the retaining portion to close the container, and a restricting portion that restricts displacement of the supply body with coming into contact with the supply body when the supply body is pressed against pressing force of the pressing portion. The supply body moves away from the retaining portion to thereby form a supply flow passage of the chemical solution to the outside of the container between the supply body and the retaining portion, and comes into contact with the retaining portion to thereby block the supply flow passage.

By being connected to the mouth portion of the container, the present chemical solution supply implement supplies the chemical solution through the supply flow passage when the supply body is pressed against the pressing force of the pressing portion, so that insufficient supply of the chemical solution is avoided. Further, since the displacement (pressing stroke) of the supply body is restricted by the supply body coming into contact with the restricting portion, excessive supply of the chemical solution through the supply flow passage is prevented. Consequently, it is possible to keep the supply amount of the chemical solution within a certain range.

The invention claimed is:

1. A chemical solution supply apparatus, comprising:

a container having a storage portion for storing a chemical solution and a mouth portion joining the storage portion and opening in a specific direction; and a chemical solution supply implement placed in the mouth portion for switching over a state where the container is sealed and a state where the chemical solution in the storage portion is allowed to be supplied to the outside of the container, wherein the chemical solution supply implement has a base placed in the mouth portion and having a shape allowing communication between the inside of the container and the outside of the container, and a supply body movably held in the base for closing and opening the communication in combination with the base to control the supplying of the chemical solution to a part to be supplied with the solution, the supply body having a supply surface protruding toward the outside of the container for allowing the chemical solution to flow on the supply surface, and a shaft portion whose axis is on a central axis of the base when the supply body entirely closes the communication, the base having a retaining portion that is positioned outside of the container and defines an opening allowing the supply body to move therethrough, and configured to come into contact with the supply surface from a side opposite to the storage portion with reference to the mouth portion to prevent detachment of the supply body from the base, a pressing portion that presses the supply body to the retaining portion to close the communication, and a restricting portion that is configured to come into contact with the supply body to restrict an axial displacement of the supply body when the supply body is pressed against pressing force of the pressing portion, and a holding portion that comes into contact with the shaft portion of the supply body to restrict a rotation of the supply body around the axis substantially parallel to the direction of an urging force pressed against the supply body.

2. The chemical solution supply apparatus according to claim 1, wherein the retaining portion has a shape that, when an off-center portion of the supply body away from a central axis parallel to a direction of action of the pressing force in a direction at right angles to the central axis is pressed, allows the supply body to tilt with respect to the base until the supply body comes into contact with the restricting portion with a contact point between a part of the supply body located opposite to the off-center portion with reference to the central axis and the retaining portion as a supporting point.

3. The chemical solution supply apparatus according to claim 2, wherein the supply body has at least one bulging portion formed at a part of the supply surface around a central axis parallel to a direction of action of the pressing force, and having a shape bulging outward from the supply surface.

4. The chemical solution supply apparatus according to claim 2, further comprising a chemical solution holding portion formed at at least one of an outer peripheral surface of the retaining portion and an outer peripheral surface of the mouth portion, for holding the chemical solution.

5. The chemical solution supply apparatus according to claim 1, further comprising a chemical solution holding portion formed at at least one of an outer peripheral surface of the retaining portion and an outer peripheral surface of the mouth portion, for holding the chemical solution.

6. The chemical solution supply apparatus according to claim 5, wherein the chemical solution holding portion is formed at the outer peripheral surface of the retaining portion, and the chemical solution holding portion has a shape recessed inward in a radial direction of the retaining portion from another part of the outer peripheral surface of the retaining portion and continuous in a circumferential direction of the retaining portion.

7. A chemical solution supply apparatus, comprising:

a container having a storage portion for storing a chemical solution and a mouth portion joining the storage portion and opening in a specific direction; and a chemical solution supply implement placed in the mouth portion for switching over a state where the container is sealed and a state where the chemical solution in the storage portion is allowed to be supplied to the outside of the container, wherein the chemical solution supply implement has a base placed in the mouth portion and having a shape allowing communication between the inside of the container and the outside of the container, and a supply body movably held in the base for closing and opening the communication in combination with the base to control the supplying of the chemical solution to a part to be supplied with the solution, the base having a retaining portion that is positioned outside of the container and defines an opening allowing the supply body to move therethrough, and configured to come into contact with a supply surface of the supply body from a side opposite to the storage portion with reference to the mouth portion to prevent detachment of the supply body from the base, a pressing portion that presses the supply body to the retaining portion to close the communication, and a restricting portion that is configured to conic into contact with the supply body to restrict an axial displacement of the supply body when the supply body is pressed against pressing force of the pressing portion, wherein the restricting portion has an annular restricting surface orthogonal to a direction of action of the pressing force, and an annular protrusion protruding outward from the restricting surface and having a shape that is annular and has line contact with the pressed supply body over an entire annular contact line to close the communication.

8. The chemical solution supply apparatus according to claim 7, wherein the retaining portion has a shape that, when an off-center portion of the supply body away from a central axis parallel to a direction of action of the pressing force in a direction at right angles to the central axis is pressed, allows the supply body to tilt with respect to the base until the supply body comes into contact with the restricting portion with a contact point between a part of the supply body located opposite to the off-center portion with reference to the central axis and the retaining portion as a supporting point.

9. The chemical solution supply apparatus according to claim 7, wherein the supply body has at least one bulging portion formed at a part of the supply surface around a central axis parallel to a direction of action of the pressing force, and having a shape bulging outward from the supply surface.

10. The chemical solution supply apparatus according to claim 7, further comprising a chemical solution holding portion formed at at least one of an outer peripheral surface of the retaining portion and an outer peripheral surface of the mouth portion, for holding the chemical solution.

11. A chemical solution supply apparatus, comprising:

a container having a storage portion for storing a chemical solution and a mouth portion joining the storage portion and opening in a specific direction; and a chemical solution supply implement placed in the mouth portion for switching over a state where the container is sealed and a state where the chemical solution in the storage portion is allowed to be supplied to the outside of the container, wherein the chemical solution supply implement has a base placed in the mouth portion and having a shape allowing communication between the inside of the container and the outside of the container, and a supply body movably held in the base for closing and opening the communication in combination with the base to control the supplying of the chemical solution to a part to be supplied with the solution, and having a supply surface protruding toward the outside of the container for allowing the chemical solution to flow on the supply surface and orienting toward the part to be supplied with the solution in use, the base having a retaining portion that is positioned outside of the container and defines an opening allowing the supply body to move therethrough, and configured to come into contact with the supply surface from a side opposite to the storage portion with reference to the mouth portion to prevent detachment of the supply body from the base, a pressing portion that presses the supply body to the retaining portion to close the communication, and a restricting portion that is configured to come into contact with the supply body to restrict an axial displacement of the supply body when the supply body is pressed against pressing force of the pressing portion, wherein the supply body has a bulging portion which extends in a direction away from the container a greater distance than a center of the supply surface, the bulging portion encouraging an inclination of the supply body so that the communication is opened when the supply body comes into contact with the part to be supplied with the solution.

12. The chemical solution supply apparatus according to claim 11, further comprising a chemical solution holding portion formed at at least one of an outer peripheral surface of the retaining portion and an outer peripheral surface of the mouth portion, for holding the chemical solution.

13. A chemical solution supply implement connectable to a mouth portion of a container having a storage portion for storing a chemical solution and the mouth portion joining the storage portion and opening in a specific direction, and which is, in a state of being connected to the mouth portion, operable to switch over a state where the container is sealed and a state where the chemical solution in the storage portion is allowed to be supplied to the outside of the container, the chemical solution supply implement comprising:

a base connectable to the mouth portion and having a shape allowing communication between the inside of the container and the outside of the container; and a supply body movably held in the base for closing and opening the communication in combination with the base to control the supplying of the chemical solution to a part to be supplied with the solution, the supply body having a supply surface protruding toward the outside of the container for allowing the chemical solution to flow on the supply surface, and a shaft portion whose axis is on a central axis of the base when the supply body entirely closes the communication, wherein the base has a retaining portion that is positioned outside of the container and defines an opening allowing the supply body to move therethrough, and configured to come into contact with the supply surface from a side opposite to the storage portion with reference to the mouth portion to prevent detachment of the supply body from the base, a pressing portion that presses the supply body to the retaining portion to close the communication, and a restricting portion that is configured to come into contact with the supply body to restrict an axial displacement of the supply body when the supply body is pressed against pressing force of the pressing portion, and a holding portion that comes into contact with the shaft portion of the supply body to restrict a rotation of the supply body around the axis substantially parallel to the direction of an urging force pressed against the supply body.

* * * * *